US010443826B2

(12) United States Patent
Kestler

(10) Patent No.: US 10,443,826 B2
(45) Date of Patent: Oct. 15, 2019

(54) METHOD AND SYSTEM FOR ILLUMINATING A WORK AREA

(71) Applicant: Gary Ray Kestler, Las Vegas, NV (US)

(72) Inventor: Gary Ray Kestler, Las Vegas, NV (US)

( * ) Notice: Subject to any disclaimer, the term of this patent is extended or adjusted under 35 U.S.C. 154(b) by 59 days.

(21) Appl. No.: 15/430,109

(22) Filed: Feb. 10, 2017

(65) Prior Publication Data

US 2017/0241629 A1 Aug. 24, 2017

Related U.S. Application Data

(60) Provisional application No. 62/298,308, filed on Feb. 22, 2016.

(51) Int. Cl.

| | |
|---|---|
| ***F21V 21/26*** | (2006.01) |
| ***F21V 21/29*** | (2006.01) |
| ***F21V 21/096*** | (2006.01) |
| ***F21V 21/08*** | (2006.01) |
| ***F21V 21/22*** | (2006.01) |
| ***F21V 15/00*** | (2015.01) |
| *F21Y 103/10* | (2016.01) |
| *F21Y 115/10* | (2016.01) |

(52) U.S. Cl.

CPC ..... *F21V 21/29* (2013.01); *F21V 15/00* (2013.01); *F21V 21/0808* (2013.01); *F21V 21/096* (2013.01); *F21V 21/22* (2013.01); *F21V 21/0832* (2013.01); *F21Y 2103/10* (2016.08); *F21Y 2115/10* (2016.08)

(58) Field of Classification Search

CPC ..... F21V 21/096; F21V 21/22; F21V 21/30; F21V 21/06; F21V 21/26; F21V 21/28; F21V 21/29

See application file for complete search history.

(56) References Cited

U.S. PATENT DOCUMENTS

| | | | | |
|---|---|---|---|---|
| 3,089,028 | A * | 5/1963 | Klampferer ..... | F21S 6/003 248/122.1 |
| 4,232,357 | A | 11/1980 | Dietz | |
| 4,744,019 | A | 5/1988 | Krogsrud | |
| 4,772,993 | A | 9/1988 | Engel | |
| 4,803,606 | A | 2/1989 | Rotter | |
| 5,124,857 | A | 6/1992 | Pitz | |
| 5,236,160 | A | 8/1993 | Sechelski | |
| 5,424,931 | A | 6/1995 | Wheeler | |

(Continued)

*Primary Examiner* — Julie A Bannan

(74) *Attorney, Agent, or Firm* — Armstrong Teasdale LLP

(57) ABSTRACT

A method and system for an area illumination device includes a support channel includes a power supply end, a first coupling end, and a first elongate body extending therebetween. A surface mounting assembly is fixedly coupled to the support channel and is configured to removably engage a first support surface of a plurality of support surfaces. A light arm includes a second coupling end, a fixture end, and a second elongate body extending therebetween. A main joint assembly is operably coupled to the first coupling end and the second coupling end and includes a plurality of degrees of freedom of motion. A light fixture includes a plurality of individual light sources coupled to the fixture end through a fixture joint assembly having at least two degrees of freedom of movement.

16 Claims, 3 Drawing Sheets

(56) References Cited

U.S. PATENT DOCUMENTS

| | | | | |
|---|---|---|---|---|
| 5,457,614 | A * | 10/1995 | Duty | F21V 19/009 362/220 |
| 5,675,417 | A | 10/1997 | Ventura et al. | |
| 6,854,862 | B1 | 2/2005 | Hopf | |
| 7,048,417 | B1 * | 5/2006 | Faure | F16M 11/24 248/124.1 |
| 7,073,926 | B1 | 7/2006 | Kremers et al. | |
| 7,690,822 | B2 | 4/2010 | Kauffman | |
| 8,172,421 | B2 | 5/2012 | Emmert | |
| 8,297,780 | B2 | 10/2012 | Emmert | |
| 8,485,702 | B2 * | 7/2013 | Payne | F21V 33/008 362/419 |
| 2006/0120092 | A1 | 6/2006 | Sapper | |
| 2009/0168412 | A1 * | 7/2009 | Murphy | F21L 4/045 362/202 |
| 2009/0225536 | A1 * | 9/2009 | Emmert | F21L 14/04 362/220 |
| 2013/0265780 | A1 * | 10/2013 | Choksi | F21V 21/145 362/373 |
| 2014/0085882 | A1 * | 3/2014 | Clifford | F21V 5/007 362/235 |

* cited by examiner

METHOD AND SYSTEM FOR ILLUMINATING A WORK AREA

BACKGROUND

The field of the disclosure relates generally to area illumination and, more particularly, to a method and system for illuminating a work area with a light device having a temporary mountable connection.

A situation exists worldwide in automotive repair facilities and possibly other similar industries whereas a car or truck is lifted in the air by means of a mechanical lift designed to do this so the underside of the vehicle can be accessed for repair or for any number of reasons. Even with up to date modern lighting in the shop, the lighting under the vehicle is dim and inadequate. Most, if not all technicians rely on battery powered flashlights or trouble lights that plug into the wall. Flashlights tend to have battery issues and seemingly fail when you need them to perform the most. Trouble lights with cords become cumbersome due to the cords becoming entangled in things, the cords get damaged due to equipment rolling over them or they become frayed due to eventual wear. This lack of suitable lighting creates lost time and delays.

BRIEF DESCRIPTION

In one embodiment, an area illumination device includes a support channel includes a power supply end, a first coupling end, and a first elongate body extending therebetween. A surface mounting assembly is fixedly coupled to the support channel and is configured to removably engage a first support surface of a plurality of support surfaces. A light arm includes a second coupling end, a fixture end, and a second elongate body extending therebetween. A main joint assembly is operably coupled to the first coupling end and the second coupling end and includes a plurality of degrees of freedom of motion. A light fixture includes a plurality of individual light sources coupled to the fixture end through a fixture joint assembly having at least two degrees of freedom of movement.

In another embodiment, a method of illuminating a work area includes coupling a support channel of an area illumination device to a first support surface of a plurality of support surfaces using a surface mounting assembly fixedly coupled to the support channel wherein the surface mounting assembly configured to removably engage the plurality of support surfaces. The method further includes moving a light arm coupled to the support channel through a main joint assembly from a first position relative to the support channel to a second position relative to the support channel and positioning a light fixture coupled to the light arm from a first position relative to the light arm to a second position relative to the light arm using a fixture joint assembly having at least two degrees of freedom of movement.

In yet another embodiment, a portable lighting system includes an articulated positioning assembly that includes a first support channel and a second support channel coupled together using a joint assembly having a plurality of degrees of freedom of movement. The portable lighting system also includes a magnetic coupling assembly coupled to the first support channel and configured to couple the first support channel to a support surface of a plurality of support surfaces, and a light fixture includes a plurality of individual point light sources coupled to the second support channel and configured to generate a light field over a work area.

BRIEF DESCRIPTION OF THE DRAWINGS

FIG. 1 is a perspective view of a light device in accordance with an example embodiment of the present disclosure.

FIG. 2 is a perspective view of light device in a working position.

FIG. 3 is another perspective view of light device in the working position.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems includes one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to portable relatively high-intensity wide-coverage area and workpiece illumination devices in industrial, commercial, and residential applications.

Embodiments of an area illumination device are described herein. In various embodiments, the area illumination device includes a support channel that includes a power supply end, a first coupling end, and a first elongate body extending therebetween. The area illumination device also includes a surface mounting assembly fixedly coupled to the support channel that is configured to removably engage a first support surface of a plurality of support surfaces. The area illumination device further includes a light arm includes a second coupling end, a fixture end, and a second elongate body extending therebetween. A main joint assembly is operably coupled to the first coupling end and the second coupling end, and includes a plurality of degrees of freedom of motion. A light fixture including a one or more individual light sources is coupled to the fixture end through a fixture joint assembly having at least two degrees of freedom of movement. Optionally, the surface mounting assembly comprises a plurality of mounting devices, at least one mounting device of the plurality of mounting devices positioned proximate the power supply end and at least one other mounting device of the plurality of mounting devices positioned proximate the coupling end. In some embodiments, the light arm comprises an extension feature configured to elongate the light arm from a retracted position to an extended position.

The following description refers to the accompanying drawings, in which, in the absence of a contrary representation, the same numbers in different drawings represent similar elements.

Figure 1:
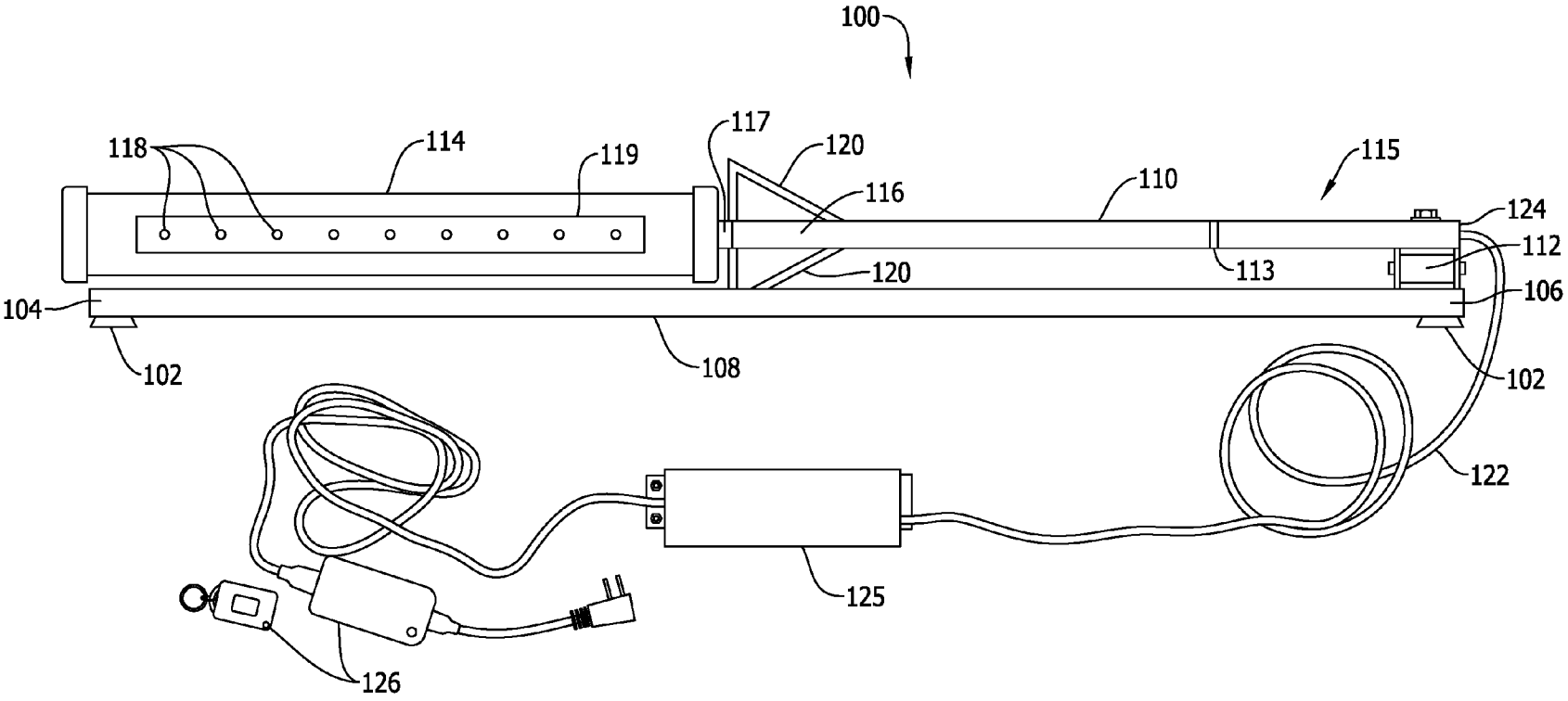
FIGS. 1-3 show example embodiments of the method and apparatus described herein.
Figure 2:
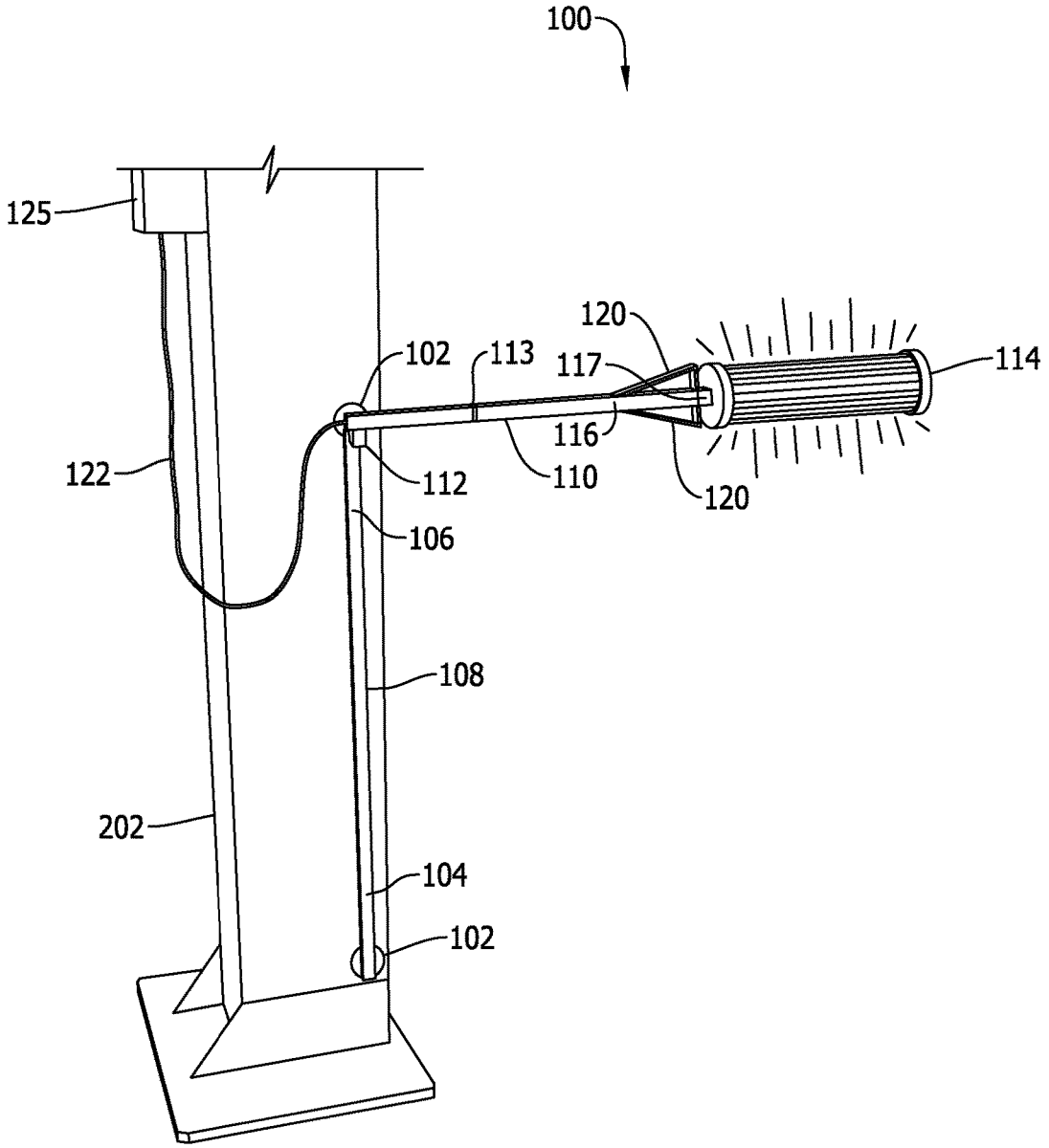
Figure 3:
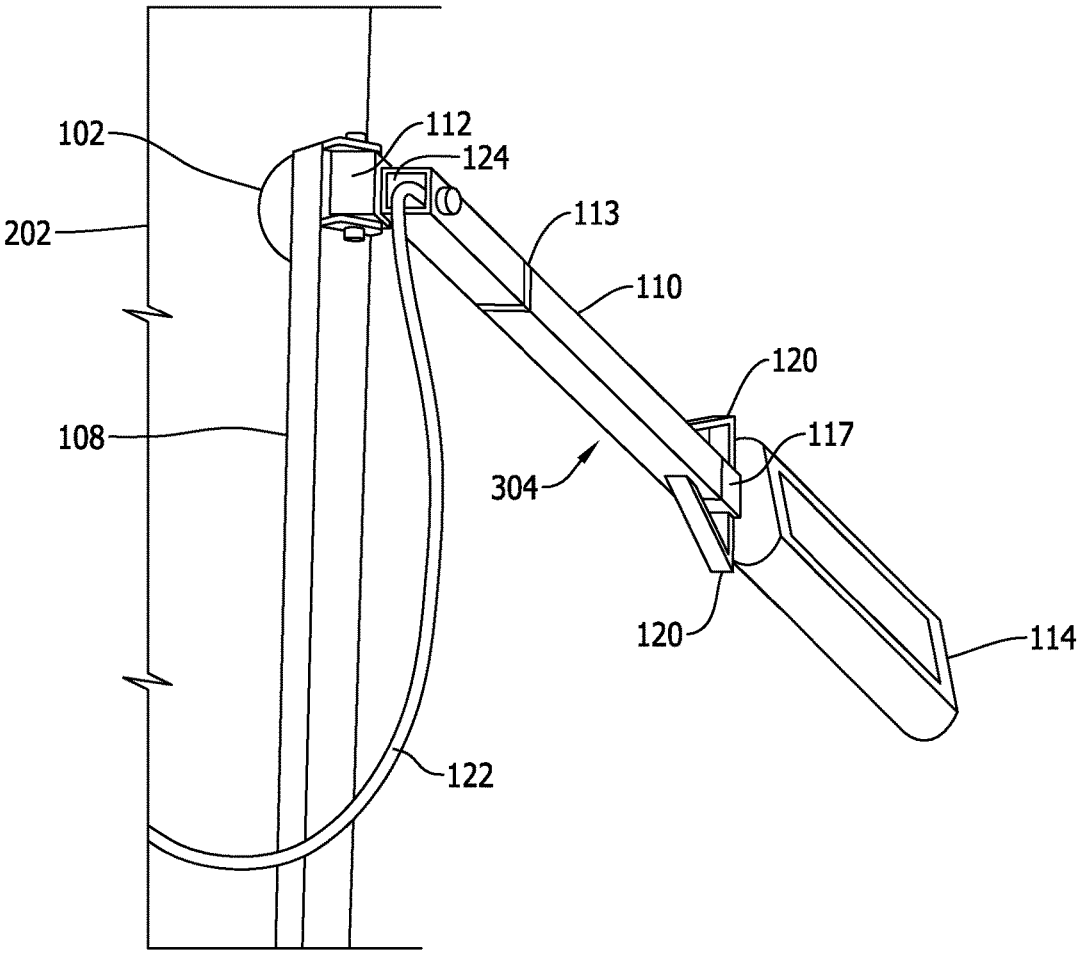

FIG. 1 is a perspective view of a light device 100 in accordance with an example embodiment of the present disclosure. FIG. 2 is a perspective view of light device 100 in a working position. FIG. 3 is another perspective view of light device 100 in a working position. In the example embodiment, light device 100 includes a plurality of temporary attachment members, such as, magnets 102. Magnets 102 are formed of rare earth elements, for example, but not limited to, neodymium and samarium-cobalt. In the example embodiment, two magnets 102 are attached at a first end 104 and a second end 106 of a main support tube 108. The magnetic connection allows portability while maintaining light device 100 securely fastened on an opportunistically available base component, for example, a support stanchion 202. A light arm 110 is pivotably coupled to second end 106 of main support tube 108 using a coupling 112 having multiple degrees of freedom of movement. Light arm 110 may also include an extension feature 113 configured to elongate the light arm 110 from a retracted position 115 to an extended position 304 (shown in FIG. 3). In various embodiments, extension feature is embodied in a telescoping arrangement of two or more segments of light arm 110. In each degree of freedom of movement, coupling 112 is configured to maintain a set position to which it is manually moved. Such ability to maintain its position is afforded by friction bearings or friction washers configured to provide a predetermined and/or adjustable amount of friction to the pivoting surfaces of coupling 112. In various embodiments, coupling 112 includes a hinge joint, a ball and socket joint, a rack and pinion arrangement, and combinations thereof.

A light source 114 is coupled to a distal end 116 of light arm 110. In one embodiment, light source 114 is coupled to distal end 116 using a fixture joint assembly 117 having at least two degrees of freedom of movement. In other embodiments, light source 114 is fixedly coupled to distal end 116. In one embodiment, light source 114 includes a plurality of point sources of light, such as, but not limited to light emitting diode (LED) lamps 118. In other embodiments, light source 114 may include a single elongate lamp 119. One or more deflection wings 120 are coupled to light arm 110 proximate light source 114 to protect light source 114 if light arm 110 is inadvertently left in a position within a path of travel of an object being illuminated, for example, a car on a shop lift that is being lowered to the ground from a maintenance position.

Light source 114 is powered through an electrical conduit 122 that is fed through a central bore 124 of electrical conduit 122. Electrical conduit 122 may be configured to carry low voltage power, such as, 12 volt direct current (DC) power from a 120 volt alternating current source through a power supply 125. A remote control device 126 may be used to control an illumination intensity or color of light source 114.

The above-described portable lighting system provides an efficient method for illuminating a work area. Specifically, the above-described portable lighting system includes a portable mounting system, an articulating and telescoping positioning system, and a light fixture configured to illuminate a large work area without regular repositioning for adequate illumination.

The above-described embodiments of a method and system of a portable lighting system provide a cost-effective and reliable means for illuminating work areas. More specifically, the methods and systems described herein facilitate providing temporary and portable light systems that are positionable close to a work area for intense illumination of the work area or positionable farther away from the work area for general illumination. As a result, the methods and systems described herein facilitate maintenance activities in a cost-effective and reliable manner.

Exemplary embodiments of work area illumination systems are described above in detail. The work area illumination systems and methods of operating such systems and component devices are not limited to the specific embodiments described herein, but rather, components of the systems and/or steps of the methods may be utilized independently and separately from other components and/or steps described herein. For example, the methods may also be used in combination with other systems that are capable of facilitating the illumination of work areas, and are not limited to practice with only the systems and methods as described herein. Rather, the exemplary embodiment can be implemented and utilized in connection with many other illumination systems and applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An area illumination device comprising:

a support channel comprising a first distal end, an opposing first joint coupling end, and a first single, straight rigid elongate body extending therebetween;

a surface mounting assembly fixedly coupled to said first distal end and to said first joint coupling end, said surface mounting assembly configured to removably engage a first support surface of a plurality of support surfaces;

a light arm comprising a second joint coupling end, a fixture end, and a second single, straight rigid elongate body extending therebetween, said second single, straight rigid elongate body comprising a telescoping feature;

a main joint assembly operably coupled to said support channel at only said first joint coupling end and to said light arm only at said second joint coupling end, said main joint assembly comprising a plurality of degrees of freedom of motion, at least one of which is a pivot motion between said support channel and said light arm; and a light fixture comprising a plurality of individual light sources coupled to said fixture end at a single location through a single fixture joint assembly having at least two degrees of freedom of movement.

2. The area illumination device of claim 1, wherein said surface mounting assembly comprises a plurality of mounting devices, at least one mounting device of the plurality of mounting devices positioned proximate said first distal end of said support channel and at least one other mounting device of the plurality of mounting devices positioned proximate said first joint coupling end of said support channel.

3. The area illumination device of claim 1, wherein said light arm comprises an extension feature configured to elongate said light arm from a retracted position to an extended position.

4. The area illumination device of claim 1, wherein said light fixture comprises a plurality of light emitting diode light sources.

5. The area illumination device of claim 1, wherein said fixture joint assembly comprises a ball and socket joint.

6. The area illumination device of claim 1, wherein said main joint assembly comprises a plurality of separate joint assemblies.

7. The area illumination device of claim 6, wherein said main joint assembly comprises a single degree of freedom of motion joint and a two degree of freedom of motion joint.

8. The area illumination device of claim 1, wherein said surface mounting assembly is configured to removably engage the plurality of support surfaces using magnetism.

9. The area illumination device of claim 1, wherein said surface mounting assembly is configured to removably engage the plurality of support surfaces using a temporary adherent.

10. The area illumination device of claim 1, wherein said surface mounting assembly is configured to removably engage the plurality of support surfaces using at least one of an adhesive, a hook and loop assembly, and a clamp.

11. A method of illuminating a work area, said method comprising:

coupling a straight rigid support channel of an area illumination device directly to a first support surface of a plurality of support surfaces using a surface mounting assembly fixedly coupled to a first distal end of the support channel and an opposing first joint coupling end of the support channel, the surface mounting assembly configured to removably engage the plurality of support surfaces;

moving a light arm pivotably coupled to the first joint coupling end of the support channel through a main joint assembly from a first angle relative to an axis of the support channel to a second angle relative to an axis of the support channel;

extending the light arm along a telescoping feature of the light arm; and positioning a light fixture coupled at a single location to a fixture end of the light arm from a first position relative to the light arm to a second position relative to the light arm using a fixture joint assembly having at least two degrees of freedom of movement.

12. The method of claim 11, wherein the fixture joint assembly includes a rotational degree of freedom of movement and wherein positioning a light fixture comprises rotating the light fixture with respect to the fixture joint assembly.

13. The method of claim 11, wherein the fixture joint assembly includes an angular degree of freedom of movement and wherein positioning a light fixture comprises pivoting the light fixture with respect to the fixture joint assembly.

14. The method of claim 11, wherein the light fixture includes a plurality of individual light sources, the method further comprising selectively energizing less than the plurality of individual light sources.

15. The method of claim 11, wherein coupling a support channel of an area illumination device to a first support surface of a plurality of support surfaces using a surface mounting assembly fixedly coupled to said support channel comprises coupling the support channel to the first support surface using a magnetic surface mounting assembly fixedly coupled to said support channel.

16. The method of claim 11, further comprising:

uncoupling the support channel of the area illumination device from the first support surface; and coupling the support channel of the area illumination device to a second support surface of the plurality of support surfaces using the surface mounting assembly, the second support surface being different than the first support surface.

* * * * *